US009630205B2

(12) United States Patent
Ueno

(10) Patent No.: US 9,630,205 B2
(45) Date of Patent: Apr. 25, 2017

(54) ELECTROSTATIC APPLICATION APPARATUS AND METHOD FOR APPLYING LIQUID

(71) Applicant: Nagase Techno-Engineering Co., Ltd., Tokyo (JP)

(72) Inventor: Tsutomu Ueno, Kanagawa (JP)

(73) Assignee: Nagase Techno-Engineering Co., Ltd., Tokyo (JP)

( * ) Notice: Subject to any disclaimer, the term of this patent is extended or adjusted under 35 U.S.C. 154(b) by 211 days.

(21) Appl. No.: 14/401,381

(22) PCT Filed: May 14, 2013

(86) PCT No.: PCT/JP2013/063453
§ 371 (c)(1),
(2) Date: Nov. 14, 2014

(87) PCT Pub. No.: WO2013/172356
PCT Pub. Date: Nov. 21, 2013

(65) Prior Publication Data

US 2015/0125619 A1 May 7, 2015

(30) Foreign Application Priority Data

May 14, 2012 (JP) ..... 2012-110933

(51) Int. Cl.
*B05D 1/00* (2006.01)
*B05B 1/02* (2006.01)
(Continued)

(52) U.S. Cl.
CPC ..... *B05D 1/007* (2013.01); *B05B 5/0255* (2013.01); *B05B 5/0533* (2013.01); *B05B 5/10* (2013.01); *B05D 1/02* (2013.01); *B05D 1/04* (2013.01)

(58) Field of Classification Search
None
See application file for complete search history.

(56) References Cited

U.S. PATENT DOCUMENTS 4,795,330 A 1/1989 Noakes et al.
4,829,996 A 5/1989 Noakes et al.
(Continued)

FOREIGN PATENT DOCUMENTS

CN 2605075 Y 3/2004
CN 1988963 A 6/2007
(Continued)

OTHER PUBLICATIONS

Grant of Patent issued in corresponding Korean Application No. 10-2014-7031006, mailed on Apr. 27, 2016 (3 pages).
(Continued)

*Primary Examiner* — Lan Vinh
*Assistant Examiner* — Bradford Gates
(74) *Attorney, Agent, or Firm* — Osha Liang LLP

(57) ABSTRACT

An electrostatic application apparatus 100 comprises a tubular electrode 1 forming a first flow path F1 whose inner surface is formed of an electrically conductive wall; a counter electrode 20 placed to block an extension of an axis line of the first flow path F1; a power source 30 applying a voltage between the tubular electrode 1 and the counter electrode 20, and a liquid supply unit 40 supplying a liquid to the first flow path F1. If an axial length of the first flow path F1 is L1 and an inside diameter of the first flow path F1 is D1, then L1/D1 is 35 or more, the inside diameter D1 of the first flow path is 0.5 to 2.0 mm, and the length L1 of the first flow path is 20 to 100 mm.

7 Claims, 1 Drawing Sheet

(51) Int. Cl.

| | |
|---|---|
| ***B05B 5/025*** | (2006.01) |
| ***B05B 5/10*** | (2006.01) |
| ***B05D 1/02*** | (2006.01) |
| ***B05B 5/053*** | (2006.01) |
| *B05D 1/04* | (2006.01) |

(56) References Cited

U.S. PATENT DOCUMENTS

| | | | | |
|---|---|---|---|---|
| 2007/0200898 | A1* | 8/2007 | Ueno | B05B 5/0255 347/55 |
| 2008/0150975 | A1 | 6/2008 | Ueno et al. | |

FOREIGN PATENT DOCUMENTS

| | | | |
|---|---|---|---|
| JP | 2640851 | B2 | 8/1997 |
| JP | 2004-136655 | A | 5/2004 |
| JP | 2006-058628 | A | 3/2006 |
| JP | 2006-305321 | A | 11/2006 |
| JP | 2007-275745 | A | 10/2007 |
| JP | 2012/035254 | A | 2/2012 |
| KR | 2005-0055727 | A | 6/2005 |
| KR | 2009-0097288 | A | 9/2009 |
| WO | 2006/011403 | A1 | 2/2006 |
| WO | 2011/153111 | A2 | 12/2011 |
| WO | 2012/008459 | A1 | 1/2012 |

OTHER PUBLICATIONS

Office Action issued in corresponding Taiwanese Application No. 102117036, mailed on Jun. 2, 2016 (5 pages).

International Preliminary Report on Patentability and Written Opinion issued in corresponding International Application No. PCT/JP2013/063453 dated Nov. 27, 2014, and English translation thereof (7 pages).

International Search Report issued in PCT/JP2013/063453, mailed on Jun. 11, 2013 (1 page).

Notification of Reasons for Refusal issued in JP Application No. 2012-110933, mailed on Nov. 6, 2012 (5 pages).

Notification of Reasons for Refusal issued in JP Application No. 2012-110933, mailed on Mar. 12, 2013 (5 pages).

Extended European Search Report issued in corresponding European Application No. 13790488.4 dated Dec. 1, 2015 (5 pages).

Office Action issued in corresponding Chinese Application No. 201380025219.0 dated Jan. 15, 2016 (7 pages).

* cited by examiner

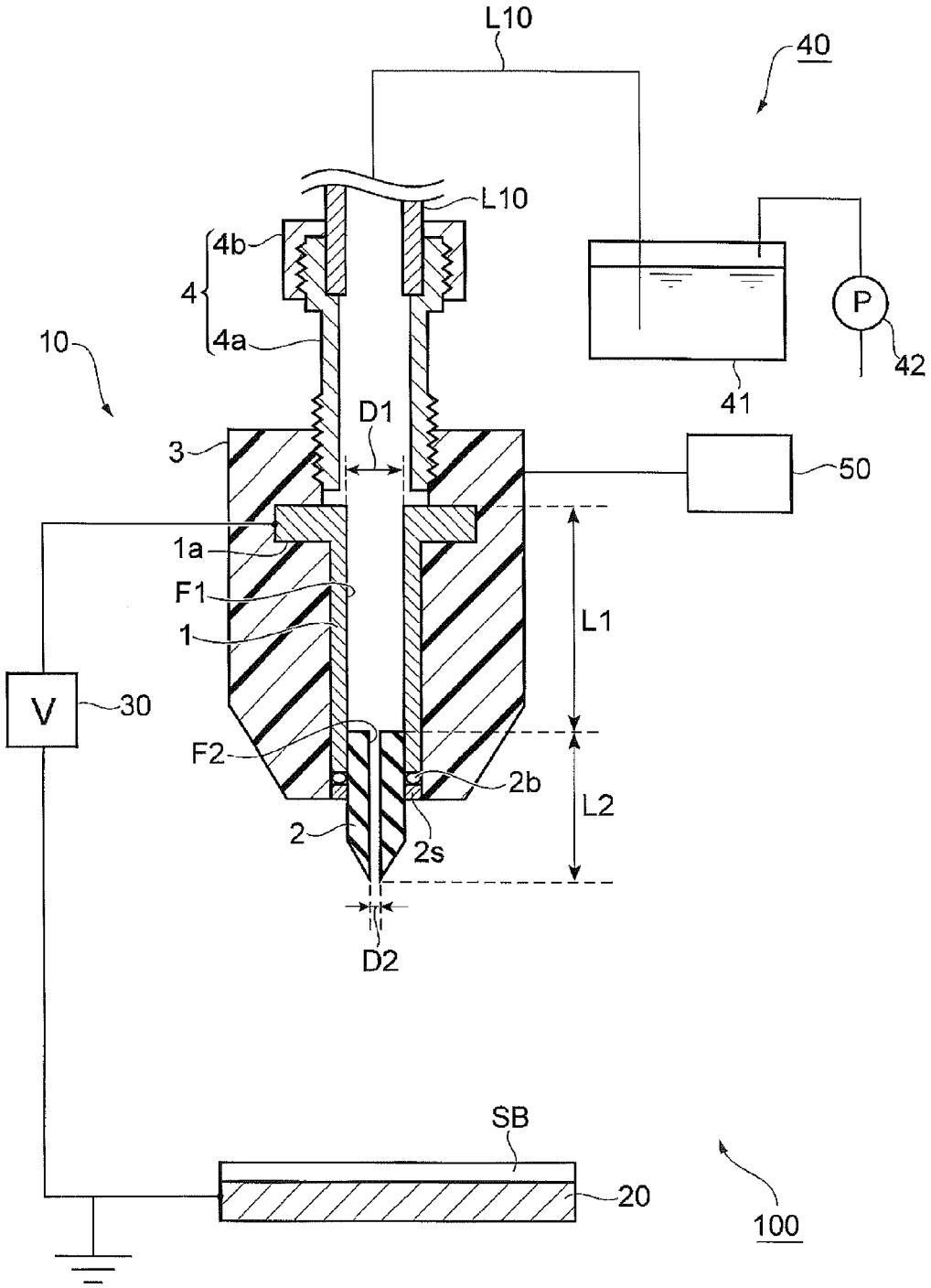
L10
40
L10
4b
4
4a
10
P
42
41
D1
3
50
1a
F1
1
L1
V
30
F2
2b
L2
2
2s
D2
SB
20
100

ELECTROSTATIC APPLICATION APPARATUS AND METHOD FOR APPLYING LIQUID

TECHNICAL FIELD

The present invention relates to an electrostatic application apparatus and a method for applying liquid using the same.

BACKGROUND ART

Conventionally, a technique is known which charges minute liquid droplets of resist or the like and causes the liquid droplets in a moist state to attach to an oppositely charged substrate.

CITATION LIST

Patent Literature

Patent Literature 1: Japanese Patent Application Laid-Open Publication No. 2006-58628

Patent Literature 2: Japanese Patent Application Laid-Open Publication No. 2004-136655

SUMMARY OF INVENTION

Technical Problem

However, with the conventional technique, miniaturization of liquid droplets reaching the substrate is not sufficient.

The present invention has been made in view of the above problem and an object of the present invention is to provide an electrostatic application apparatus which can make particle sizes of liquid droplets reaching a substrate sufficiently small as well as a method for applying liquid using the electrostatic application apparatus which uses the electrostatic application apparatus.

Solution to Problem

An electrostatic application apparatus according to the present invention comprises:

a tubular electrode forming a first flow path whose inner surface is formed of an electrically conductive wall;

a counter electrode placed to block an extension of an axis line of the first flow path;

a power source applying a voltage between the tubular electrode and the counter electrode; and a liquid supply unit supplying a liquid to the first flow path, wherein if an axial length of the first flow path is L1 and an inside diameter of the first flow path is D1, then L1/D1 is 35 or more, the inside diameter D1 of the first flow path is 0.5 to 2.0 mm, and the length L1 of the first flow path is 20 to 100 mm.

According to the present invention, liquid droplets discharged from a nozzle are easily subjected to Rayleigh fission at a low voltage and it is possible to form fine liquid droplets.

Also, preferably the electrostatic application apparatus further comprises a nozzle configured to form a second flow path which is communicated with the first flow path and has an inside diameter smaller than the inside diameter of the first flow path. Consequently, even if D1 is large, it is possible to easily eject small liquid droplets.

Also, preferably the inside diameter D2 of the second flow path is 0.1 to 0.5 mm.

Also, preferably the nozzle is electrically insulative. This makes it possible to inhibit electric discharges and the like from the nozzle.

Also, preferably the liquid supply unit supplies a resist solution to the flow path of the tubular electrode.

A method for applying liquid according to the present invention uses the electrostatic application apparatus described above.

Also, another method for applying liquid according to the present invention uses the electrostatic application apparatus described above and applies a voltage of 10 kV or less from the power source.

Advantageous Effects of Invention

The present invention can make the particle sizes of liquid droplets reaching the substrate sufficiently small. Thus, a very thin liquid film, for example, in the order of 0.5 to 100 μm can be formed on an object.

BRIEF DESCRIPTION OF THE DRAWING

FIG. 1 is a partial cutaway schematic block diagram of an electrostatic application apparatus 100 according to an embodiment of the present invention.

DESCRIPTION OF EMBODIMENTS

An embodiment of the present invention will be described with reference to the drawings.

FIG. 1 is a partial cutaway schematic block diagram of an electrostatic application apparatus 100 according to the embodiment of the present invention. The electrostatic application apparatus 100 according to the present embodiment comprises a nozzle unit 10, a counter electrode 20, a power source 30, a liquid supply unit 40, and a nozzle unit moving unit 50.

The nozzle unit 10 comprises a tubular electrode 1, a nozzle 2, and a cover 3.

The tubular electrode 1 is a circular cylinder provided with an outer flange 1*a* at an upper end, and an inside diameter D1 is constant. The tubular electrode 1 is made, for example, of an electrically conductive material such as stainless steel and forms a first flow path F1 whose inner surface is formed of an electrically conductive wall.

When a length of the first flow path F1 is L1 and an inside diameter of the first flow path F1 is D1, then L1/D1[−] is 35 or more, preferably 40 or more, and more preferably 50 or more. Although there is no particular upper limit to L1/D1 [−], 100 or less is preferable, 80 or less is more preferable, and 60 or less is still more preferable.

Specifically, D1 is preferably 0.5-2.0 mm, and more preferably 0.5 to 1.0 mm Preferably the length L1 is 20 to 100 mm, and more preferably 40 mm or more, and more preferably 80 mm or less.

The nozzle 2 is installed at a tip of the tubular electrode 1. The nozzle 2 is made of an electrically insulative material such as glass, ceramics, or resin, and forms a second flow path F2 communicated with the first flow path F1.

An inside diameter D2 of the second flow path is smaller than the inside diameter D1 of the first flow path F1. Specifically, D2 is preferably 0.1 to 0.5 mm, and more preferably 0.1 to 0.3 mm.

Preferably a length L2 of the second flow path F2 is smaller than the length of the first flow path F1 although not particularly limited. Specifically, L2 is preferably 5 to 20 mm, and more preferably 5 to 10 mm.

An outer surface of a lower end of the nozzle 2 is set to be conical in shape. This allows liquid droplets to be ejected accurately toward a substrate. Preferably an angle of a cone, i.e., an angle formed by an axis of the nozzle 2 and a conical surface in a cross section containing the axis, is 45° or less, and more preferably 35° or less.

According to the present embodiment, a metal support 2*s* is fixed around the nozzle 2, and with part of the nozzle 2 inserted in the tubular electrode 1, the support 2*s* is in contact with a lower end face of the tubular electrode 1 via an O-ring 2*b*.

The cover 3 is shaped to cover the tubular electrode 1 and nozzle 2 and provided in upper part with an opening communicated with the flow path F1. The cover 3 is made of an electrically insulative material such as resin (PTFE or the like). An inner surface of an opening in upper part of the cover 3 has a female thread cut therein and is connected with a pipe joint 4. The pipe joint 4 includes a joint body 4*a* and a nut 4*b* configured to connect a tip of a line L10 to the joint body 4*a*.

The counter electrode 20 is placed on the opposite side of the nozzle 2 from the tubular electrode 3. The counter electrode 20 is placed on an extension of an axis line of the first flow path F1, blocking the extension, and is spaced away from the tubular electrode 1 and nozzle 2. Preferably the counter electrode 20 is grounded.

According to the present embodiment, the counter electrode is plate-shaped and a substrate SB to be coated is set on the counter electrode.

The power source 30 applies a voltage between the tubular electrode 1 and counter electrode 20. Normally, the voltage is a direct-current voltage and is preferably supplied, for example, in a pulsed manner. According to the present embodiment, the voltage can be set to 5 to 20 kV although not particularly limited. Preferably, the voltage is applied such that the tubular electrode 1 is a positive side relative to the counter electrode 20.

The liquid supply unit 40 is an apparatus which supplies a liquid to the first flow path F1 via the line L10.

According to the present embodiment, the liquid supply unit 40 comprises a tank 41 configured to store a liquid, and a pump 42 configured to supply a resist solution to the tubular electrode 1 from the tank 41 via the line L10. According to the present embodiment, as the pump 42 supplies air to the tank 41 which is in an enclosed state, the liquid is supplied to the first flow path F1 via the line L10.

According to the present embodiment, the liquid supply unit 40 supplies the resist solution to the first flow path F1. The resist solution is a mixture which contains a resin such as a novolak resin, a sensitizer such as a naphtho diazide, and a solvent such as PGMEA (propylene glycol methyl ether acetate). A preferred viscosity range of the resist solution is 5-1000 mPa·s. Examples of the resist include, NPR3510 produced by Nagase ChemteX Corporation.

The nozzle unit moving unit 50 causes the nozzle unit 10 to move relative to the counter electrode 20. Specifically, for example, if the object is a substrate SB, the nozzle unit 10 can move independently along two axes in a plane horizontal to a surface of the substrate SB. This allows the liquid to be applied to a desired part on the substrate SB. Also, preferably the nozzle unit moving unit 50 can cause the nozzle unit 10 to move relative to the counter electrode 20 in a direction perpendicular to the substrate SB as well. This makes it easy to adjust a distance between a tip of the nozzle 2 and the substrate SB as well.

Next, an application method using the electrostatic application apparatus 100 of the present embodiment will be described.

First, a substrate SB to be coated is set on the counter electrode 20. Next, a voltage is applied between the tubular electrode 1 and counter electrode 20 by the power source 30. Also, by driving the pump 42, the liquid in the tank 41 is supplied to tips of the first flow path F1 and second flow path F2 via the line L10. The liquid is charged with an electric charge given by the tubular electrode 1, the liquid protruded from the nozzle 2 forms a Taylor cone, and charged liquid droplets are ejected from a tip of the cone toward the counter electrode having an opposite charge. In so doing, according to the present embodiment, since L1/D1 of the tubular electrode 1 is 35 or more, the electric charge can efficiently be given to the liquid and the liquid droplets can easily be caused to undergo Rayleigh fission. For example, in the case of a resist solution, Rayleigh fission can be caused even at a voltage of 10 kV or less. Consequently, liquid resist droplets with a diameter of, for example, 3 to 5 μm can be formed and supplied to a desired part on the substrate SB.

Then, by adjusting a distance between the nozzle 2 and substrate SB and supplying a lot of liquid droplet clusters with the solvent being undried to the substrate SB, it is possible to make a liquid film dense by merging the liquid droplets on the substrate or make thickness uniform. Consequently, after formation of the liquid film, the liquid droplets in the liquid film do not necessarily have to be held in the atmosphere of the solvent in order to merge the liquid droplets. A preferred distance between the nozzle 2 and the substrate SB is 10 to 100 mm.

Although the reason why L1/D1 of 35 or more makes it easy for Rayleigh fission to occur is not clear, it is considered that smaller the D1, the closer the distance from an inner surface (wetted portion) of the tubular electrode 1 to the liquid, making it easier to give a charge to the liquid via the tubular electrode 1, and that the larger the L1, longer a distance of contact with the liquid, making it easier to give a charge to the liquid.

The present invention is not limited to the embodiment described above, and various modified forms are possible.

For example, although in the above embodiment, the nozzle 2 is installed to reduce the diameter of the liquid droplets ejected initially, if D1 is as small as, for example, about 0.1 mm or less, it is possible to form minute liquid droplets without the nozzle 2.

Also, although in the above embodiment, the nozzle 2 is configured to be electrically insulative to inhibit electric discharges and the like from the nozzle, the nozzle 2 can also be implemented even if made of an electrically conductive material.

Also, although in the above embodiment, the nozzle 2 is inserted in the tubular electrode 1, this is not restrictive, and, for example, a form in which the upper end face of the nozzle 2 is in contact with the lower end face of the tubular electrode 1 can be implemented.

Also, although in the above embodiment, the inside diameter D1 of the first flow path F1 is constant, the first flow path F1 can be, for example, a tapered tube whose inner surface is sloped at an angle of 15° or less with respect to an axis line in a section containing an axis as well. The inside diameter D1 in this case can be defined as an average diameter integrated along an axial direction. The same holds for the second flow path F1 of the nozzle 2.

Also, a shape of the tubular electrode 1 is not particularly limited as long as the first flow path F1 can be formed. For example, the flange 1*a* may be omitted.

Also, needless to say, the cover 3 is not essential. For example, the line L10 can be connected directly to the tubular electrode 1.

Also, although in the present embodiment, since the object to be coated with a liquid is a substrate SB, the counter electrode 20 is plate-shaped as well, a shape of the counter electrode 20 can be changed to a desired form according to a shape of the object to be coated. Also, the object to be coated is not particularly limited. For example, a liquid can be applied to various objects such as a substrate with a rugged surface.

Also, although in the above embodiment, the liquid supply unit 40 applies a resist solution (mixture of a photosensitive resin and solvent) to the first flow path F1, various other liquids can be supplied. Examples of such liquids include a liquid mixture of a non-photosensitive resin and solvent, a polymerizable liquid monomer (e.g., liquid acrylic monomer such as 1,9-nonanediol acrylate, 1,1,1-trimethylol propane triacrylate) used as a surface protective film coating liquid or the like, a paste of metal particles (silver, gold, copper, or the like) and solvent, and an adhesive. A preferred viscosity range of the liquid is 5 to 1000 mPa·s. The solvent is not limited, and various kinds of polar solvents and nonpolar solvents including water and organic solvents are available for use.

Also, a configuration of the liquid supply unit 40 is not particularly limited. For example, in the case of a form in which a pump is connected to the line L1 or a form in which the pump 42 is a compressed gas source or in the case where a feed rate of the liquid is low and the liquid can be supplied by negative pressure in the first flow path F1 or a water head difference alone, just the line L1 will do. In short, it is sufficient if the liquid can be supplied to the first flow path F1.

EXAMPLES

Using the electrostatic application apparatus such as shown FIG. 1, a voltage at which liquid droplets of 3 to 5 μm were obtained on a substrate was measured by varying L1 and D1.

Liquid: resist solution (propylene glycol monomethyl ether acetate (60 to 80 wt %), novolak resin (15 to 30 wt %), naphtho-quinone diazide ester (<10 wt %), and surface-active agent (<1 wt %))

Tubular electrode: made of stainless steel, length L1 [mm] of first flow path F1, inside diameter D1 of first flow path F1

Nozzle: made of glass, length L2 of second flow path F2=10 mm, diameter D2 of second flow path F2=100 μm Substrate (Si substrate), distance between substrate and nozzle 2: 40 mm Results are shown in Table 1.

TABLE 1

| | L1 (mm) | D1 (mm) | L1/D1 (—) | Required voltage (kV) |
|---|---|---|---|---|
| Example 1 | 50 | 1.0 | 50 | 6 |
| Example 2 | 40 | 1.0 | 40 | 8 |
| Example 3 | 50 | 0.6 | 83 | 5 |

TABLE 1-continued

| | L1 (mm) | D1 (mm) | L1/D1 (—) | Required voltage (kV) |
|---|---|---|---|---|
| Comparative example 1 | 20 | 1.0 | 20 | 20 |
| Comparative example 2 | 10 | 1.0 | 10 | 30 |
| Comparative example 3 | 50 | 2.0 | 25 | 20 |
| Comparative example 4 | 50 | 5.0 | 10 | 40(*) |

(*)Formation of liquid droplets was unstable.

Furthermore, an experiment was conducted in a similar manner using an acrylic monomer coating solution (polymerizable liquid monomer (1,9-nonanediol acrylate) and results similar to those in the case of the resist solution described above were obtained.

REFERENCE SIGNS LIST

1 . . . tubular electrode, 2 . . . nozzle, 20 . . . counter electrode, 30 . . . power source, 40 . . . liquid supply unit, F1 . . . first flow path, F2 . . . second flow path, 100 . . . electrostatic application apparatus.

The invention claimed is:

1. An electrostatic application apparatus comprising:

a tubular electrode forming a first flow path whose inner surface is formed of an electrically conductive wall;

a counter electrode placed to block an extension of an axis line of the first flow path;

a power source applying a voltage between the tubular electrode and the counter electrode; and a liquid supply unit supplying a liquid to the first flow path, wherein if an axial length of the first flow path is L1 and an inside diameter of the first flow path is D1, then L1/D1 is 35 or more, the inside diameter D1 of the first flow path is 0.5 to 2.0 mm, and the length L1 of the first flow path is 20 to 100 mm.

2. The electrostatic application apparatus according to claim 1, further comprising a nozzle forming a second flow path which is communicated with the first flow path and which has an inside diameter smaller than the inside diameter of the first flow path.

3. The electrostatic application apparatus according to claim 2, wherein the inside diameter D2 of the second flow path is 0.1 to 0.5 mm.

4. The electrostatic application apparatus according to claim 2, wherein the nozzle is electrically insulative.

5. The electrostatic application apparatus according to claim 1, wherein the liquid supply unit supplies a resist solution to the flow path of the tubular electrode.

6. A method for applying liquid, comprising applying the liquid by using the electrostatic application apparatus according to claim 1.

7. A method for applying liquid, comprising applying a voltage of 10 kV or less from the power source by use of the electrostatic application apparatus according to claim 1.

* * * * *